US009075392B2

(12) United States Patent
Stranczl

(10) Patent No.: US 9,075,392 B2
(45) Date of Patent: Jul. 7, 2015

(54) FLEXIBLE RESILIENT HAND

(71) Applicant: Omega S.A., Bienne (CH)

(72) Inventor: Marc Stranczl, Nyon (CH)

(73) Assignee: Omega S.A., Bienne (CH)

( * ) Notice: Subject to any disclaimer, the term of this patent is extended or adjusted under 35 U.S.C. 154(b) by 0 days.

(21) Appl. No.: 14/501,246

(22) Filed: Sep. 30, 2014

(65) Prior Publication Data

US 2015/0109891 A1 Apr. 23, 2015

(30) Foreign Application Priority Data

Oct. 18, 2013 (EP) ..... 13189231

(51) Int. Cl.
*G04B 19/04* (2006.01)
*G04B 45/00* (2006.01)

(52) U.S. Cl.
CPC ..... *G04B 19/046* (2013.01); *G04B 19/042* (2013.01); *G04B 45/0061* (2013.01)

(58) Field of Classification Search
CPC .... G04B 19/04; G04B 19/042; G04B 19/044; G04B 19/046; G04B 45/0061
USPC ..... 368/77, 223, 232, 233, 238
See application file for complete search history.

(56) References Cited

U.S. PATENT DOCUMENTS 3,952,500 A * 4/1976 Tomura ..... 368/229
4,601,585 A * 7/1986 Farley ..... 368/80
4,712,924 A * 12/1987 Agostini ..... 368/76
4,885,729 A * 12/1989 Lee ..... 368/76
6,208,592 B1 * 3/2001 Turner ..... 368/76

FOREIGN PATENT DOCUMENTS

| | | |
|---|---|---|
| FR | 2 868 556 A1 | 10/2005 |
| JP | 62-104115 U | 7/1987 |
| JP | 62-239080 | 10/1987 |
| JP | 2011-163914 | 8/2011 |

OTHER PUBLICATIONS

European Search Report issued Apr. 29, 2014 in European Application 13189231, filed on Oct. 18, 2013 ( with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

Resilient timepiece hand including a first drive pipe integral with a flexible strip.

The resilient hand is in a single-piece and this flexible strip includes a first flexible segment between this first pipe and a first tip which is at a variable distance from this first pipe according to stresses applied to this flexible strip.

Timepiece display mechanism including a resilient hand of this type. The mechanism includes a first drive pinion for driving this first pipe of this resilient hand about a pivot axis, and a second pinion or a cam for stressing this resilient hand to vary the position of at least one this tip of this resilient hand with respect to this pivot axis.

Watch including a display movement of this type.

16 Claims, 2 Drawing Sheets

FLEXIBLE RESILIENT HAND

This application claims priority from European Patent application No. 13189231.7 filed Oct. 18, 2013, the entire disclosure of which is hereby incorporated by reference.

FIELD OF THE INVENTION

The invention concerns a resilient timepiece hand, including a first drive pipe integral with a flexible strip.

The invention also concerns a timepiece display mechanism including at least one resilient hand of this type.

The invention also concerns a timepiece movement including at least one display mechanism of this type.

The invention also concerns a timepiece including at least one timepiece movement of this type and/or at least one display mechanism of this type.

The invention also concerns a scientific apparatus including at least one timepiece movement of this type and/or at least one display mechanism of this type.

The invention concerns the field of analogue display mechanisms using moving mechanical components, for timepieces or scientific apparatuses.

BACKGROUND OF THE INVENTION

For the analogue display of certain quantities via one or more indicators facing dials or graduated markings, it may be necessary to distinguish between certain ranges of values of the displayed quantity. For example, for the current time display, commonly achieved by a twelve hour rotation of a hand, it is advantageous to differentiate between the morning hours and the afternoon hours.

It is known to deploy a hand via a pantograph system to give the hand a variable radial extension according to its angular position. However, in addition to the difficulty and cost of production, this type of mechanism is fragile and essentially suited to static uses, and it is unsuitable for an object which may be subjected to shocks, such as a watch or scientific apparatus, such as a measuring instrument.

JP Patent Application No 2011 163914A in the name of CITIZEN discloses a radio controlled timepiece, including hollowed out hands covering antennas.

JP Utility Model No S62104115U in the name of MATSUMOTO also discloses hollowed out hands.

SUMMARY OF THE INVENTION

The invention proposes to provide a reliable and extremely robust solution to the problem of providing an indicator having variable radial extension according to the position and control of the indicator.

To this effect, the invention concerns a resilient timepiece hand, including a first drive pipe integral with a flexible strip, characterized in that said resilient hand is in a single piece and has a variable geometry, and in that said flexible strip includes a plurality of flexible segments connected end-to-end at at least one tip, a first segment of which is flexible between said first pipe and a first tip and which is deformable between a first compressed position wherein said first tip is at a first close distance from said first pipe, and a first relaxed position wherein said first tip is at a first remote distance from said first pipe which is greater than said first close distance, and in that said resilient hand includes a second drive pipe also integral with said flexible strip, and in that said first pipe and said second pipe are spaced apart from each other in a free state of said resilient hand, and are mounted coaxially to each other along a common axis in a stressed operating state of said resilient hand which is a stressed state wherein said first pipe and said second pipe can each occupy different angular positions, and in that said flexible strip includes at least a second flexible element between said second pipe and an intermediate tip which is one of said tips, and in that said second flexible tip is deformable between a second compressed position wherein said intermediate tip is at a second close distance from said second pipe, and a second relaxed position wherein said intermediate tip is at a second distance remote from said second pipe which is greater than said second close distance.

The invention also concerns a timepiece display mechanism including at least one resilient hand of this type, characterized in that the mechanism includes first means of driving said first pipe of said at least one resilient hand about a pivot axis, and second means of stressing said at least one resilient pipe to vary the position of at least one said tip of said at least one resilient hand with respect to said pivot axis.

The invention also concerns a timepiece movement including at least one display mechanism of this type.

The invention also concerns a timepiece including at least one timepiece movement of this type and/or including at least one striking mechanism or a musical box including a display mechanism of this type.

The invention also concerns a scientific apparatus including at least one timepiece movement of this type and/or at least one display mechanism of this type.

BRIEF DESCRIPTION OF THE DRAWINGS

Other features and advantages of the invention will appear upon reading the following detailed description, with reference to the annexed drawings, in which:

FIG. 2A illustrates the rest state of this resilient hand including a flexible strip having two resilient segments connected to each other by a tip, the ends of the strip being integral with a first pipe and with a second pipe.

FIG. 2B illustrates the resilient hand of FIG. 2A in a stressed state wherein the two end pipes are coaxially superposed on each other with a certain angular shift which makes the resilient hand long and narrow.

FIG. 2C illustrates the same resilient hand of FIGS. 2A and 2B in another stressed state wherein the two end pipes are coaxially superposed on each other with a greater angular shift than that of FIG. 2B, the new angular shift making the resilient hand short and wide.

FIG. 5A illustrates the rest state of this resilient hand with the two pipes superposed.

FIG. 5B illustrates the resilient hand of FIG. 5A in a long position wherein a torque tends to move the two pipes closer together.

FIG. 5C illustrates the same resilient hand of FIGS. 5A and 5B in a short position where a torque tends to move the two pipes closer together.

DETAILED DESCRIPTION OF PREFERRED EMBODIMENTS

The invention concerns a display indicator for a timepiece or scientific apparatus. According to the invention, this display indicator is a shape memory indicator, and its instantaneous shape depends on at least one drive means which is applied to a particular area of the display indicator.

The invention is described here in the particular, but non-limiting case of a rotating indicator, and particularly a resilient hand. However, the principle is applicable to an indicator having a non-circular trajectory of mobility, for example with a linear cursor, or suchlike, particularly in space.

Likewise, drive means including gear trains are described below, but the invention is equally applicable to analogue display means for an electronic or electrical apparatus, a quartz watch or other device.

The principle of the invention is to create a display mechanism, wherein at least one indicator, particularly a hand, for example the hour hand for a watch, has a variable length, or a variable radial extension.

Figure 1:
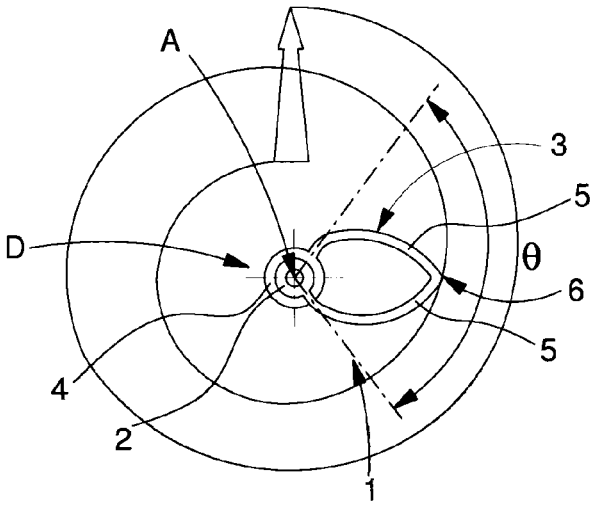
FIG. 1 shows a schematic plan view of an example display mechanism including a resilient hand of variable length according to the invention, whose distal end follows a non-circular trajectory, in particular a helical trajectory over two revolutions of a drive arbor, and an instantaneous radial return in maximum extension after these two revolutions.

FIG. 1 illustrates the trajectory of an end tip of a resilient hand 1 according to the invention, mounted in a conventional watch movement completing one revolution in 12 hours, which is described in more detail below. This trajectory includes two complete coils of a spiral. This trajectory makes it possible to represent, on a dial, the day on the outer coil and the night on the inner coil, or the morning and afternoon, or suchlike. The spiral trajectory is thus covered in 24 hours in 2 turns.

The invention thus concerns a resilient display indicator, and more particularly a single-piece, flexible, resilient hand 1 of variable length. This resilient timepiece hand 1 includes a first drive pipe 2 integral with a flexible strip 3. The invention is more precisely described for this application of a flexible indicator to a hand, but it clear that it is applicable to other plane or three-dimensional indicator shapes.

According to the invention, this resilient hand 1 is in a single-piece and of variable geometry.

Flexible strip 3 includes a plurality of flexible segments 5 connected end-to-end at at least one tip 6, 61. Among these flexible segments 6, a first segment 51 is flexible between first pipe 2 and a first tip 61, and this first segment 51 is deformable between a first compressed position wherein first tip 61 is at a first close distance from first pipe 2, and a first relaxed position wherein first tip 61 is at a first remote distance from first pipe 2, said first remote distance being greater than said first close distance.

Resilient hand 1 also includes a second drive pipe 4 also integral with flexible strip 3.

First pipe 2 and second pipe 4 are spaced apart from each other in a free state of resilient hand 1. First pipe 2 and second pipe 4 are mounted coaxially to each other along a common axis A in a stressed operating state of resilient hand 1, which is a stressed state wherein first pipe 2 and second pipe 4 can occupy different angular positions.

Flexible strip 3 includes at least a second flexible segment 53 between second pipe 4 and an intermediate tip which is one of tips 6, 61. In a particular embodiment illustrated in the Figures, this intermediate tip coincides with the first tip.

This second flexible segment 53 is deformable between a second compressed position wherein the intermediate tip is at a second close distance from second pipe 4, and a second relaxed position wherein the intermediate tip is at a second remote distance from second pipe 4, which is greater than the second close distance.

It is clear that each tip 6 and particularly the first tip, is at a variable distance from first pipe 2, according to the stresses applied to flexible strip 3 and/or the stresses to which the tip itself is subjected.

Figure 6A:
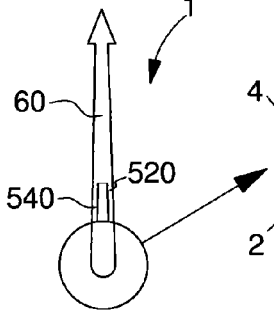
FIGS. 6A and 6B illustrate, in a plan view and perspective view, a variant hand with a solid part attached to the pipes by flexible strips.
Figure 6B:
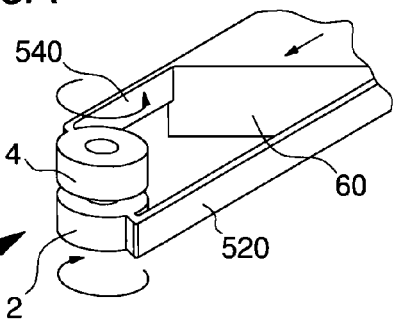
Figure 7:
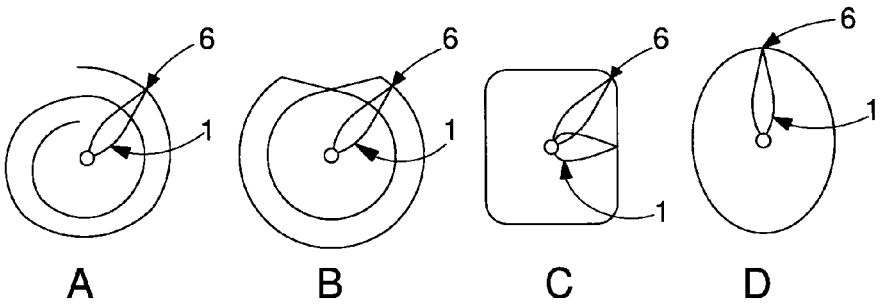
FIG. 7 shows at A, B, C, D, various possible example trajectories for the tip of the resilient hand according to the invention.

In some variants, as in FIG. 6B, one segment 5 carries first pipe 2 at a first end 52, another segment 5 carries second pipe 4 at a second end 54 and, in the free state of resilient hand 1, the first end 52 and second end 54 are remote from each other or form a non-zero angle with each other.

The invention is described and illustrated with a simple hand variant 1 including a single tip 6 between two segments 5, a first segment 51 and a second segment 53, but it is applicable to more complex geometries. The resilient hand 1 of FIG. 2A includes only this first segment 51, carrying first pipe 2 at a first end 52, and this second segment 53, carrying second pipe 4 at a second end 54, connected to each other by first tip 61, In the free state of resilient hand 1, first end 52 and second end 54 are remote from each other and form a non-zero angle with first tip 61.

In the particular, non-limiting application illustrated in the Figures, particularly FIG. 1 for this same hand, in the stressed operating state of resilient hand 1 where first pipe 2 and second pipe 4 are movable with respect to each other and coaxial along common axis A, the distance between at least one tip 6, 61 and common axis A is a function of the angular deviation θ between the first angular position of first pipe 2 and the second angular position of second pipe 4.

Other variants can be envisaged by replacing first pipe 2 or second pipe 4 with other drive means, such as connecting rods, cams, or suchlike.

In a preferred implementation of the invention wherein hand 1 thus includes a first pipe 2 and a second pipe 4, in a stressed state of resilient hand 1 where first pipe 2 and second pipe 4 are movable with respect to each other, the distance between at least one tip 6 and first pipe 2 is a function of the distance between first pipe 2 and second pipe 4 and/or the angular deviation θ between first pipe 2 and second pipe 4. This first pipe 2 and second pipe 4 can thus follow any type of motion: linear, pivoting, combined or in space, which offers the invention numerous possibilities to execute any desired type of display. It is possible, in particular, to give the tip 6 of this type of hand 1 a three-dimensional motion, moving for example in a space delimited by a hemispheric or similar glass: means of driving first pipe 2 in a plane XY define a plane P passing through axis Z perpendicular to plane XY, and means of driving second hand 4 define a radial mobility of tip 6 of hand 1 in this plane P. This type of application is advantageous in particular for astronomical watches and clocks, and makes it possible to draw trajectories in space such as elliptical or other orbits.

The invention also concerns a timepiece display mechanism 10 including at least one resilient hand 1 of this type. This display mechanism 10 includes first means 11 of driving first pipe 2 of said at least one resilient hand 1 about a pivot axis D, and second means 12 of stressing said at least one resilient hand 1, to vary the position of at least one tip 6 of said at least one resilient hand 1 with respect to pivot axis D.

Figure 9:
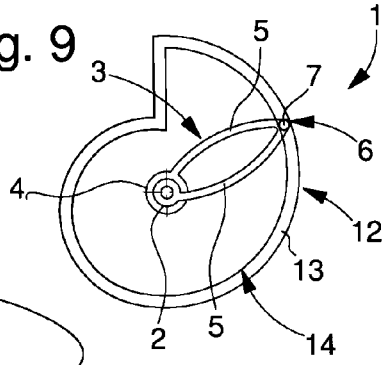
FIG. 9 shows a resilient hand variant according to the invention whose tip includes a stylus guided in a path and/or on a cam.

In particular embodiments, for example as seen in FIG. 9, the second stressing means 12 include at least one guide path or cam 14 for a said tip 6 or for an extension of said tip 6. Resilient hand 1 then advantageously includes, on at least one tip 6, a stylus 7 arranged to follow a cam path or similar.

Figure 4:
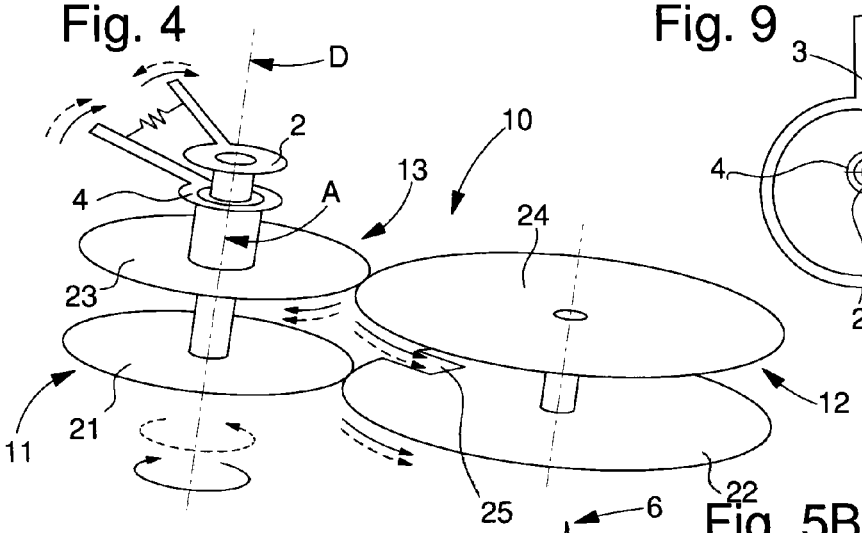
FIG. 4 shows a schematic, partial and perspective view of a display mechanism including a resilient hand of this type subjected to first drive means, and stressed by second stressing means to vary the radial extension of the hand.

Preferably, as seen in FIG. 4, mechanism 10 includes at least one resilient hand 1, with a second pipe 4 and second stressing means 12 include second means 13 of driving said second pipe 4.

In an illustrated variant, second means 13 of driving second pipe 4 are coaxial to first means 11 of driving first pipe 2.

Advantageously, in the stressed operating state, resilient hand 1 is arranged to permanently exert on first drive means 11 and on second drive means 13 a torque tending to take up any operating play between first drive means 11 and second drive means 13.

In a particular application, first drive means 11 and second drive means 13 are pivotal drive means, and the pivoting speeds of first drive means 11 and second drive means 13 are different from each other. Preferably, the deviation on a given travel of first pipe 2, in particular, but not restrictively, an integer number of revolutions of first pipe 2, is made up by a jump between the first drive means 11 and second drive means 13.

Display mechanism 10 advantageously includes control means 15 for controlling the pivoting speed of first drive means 11 and of second drive means 13, and the angular position of at least first pipe 2. These control means 15 are arranged to impose a particular trajectory on at least one tip 6 of said at least one resilient hand 1 comprised in mechanism 10.

Figure 2A:
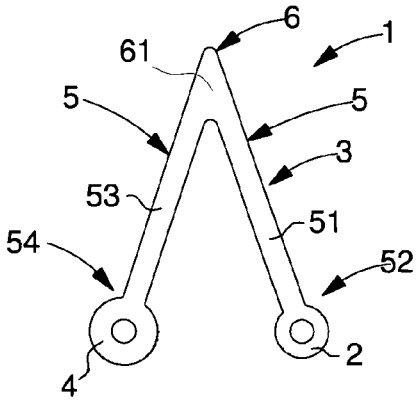
FIGS. 2A to 2C show schematic plan views of a single-piece resilient hand according to the invention, with variable radial extension.
Figure 2B:
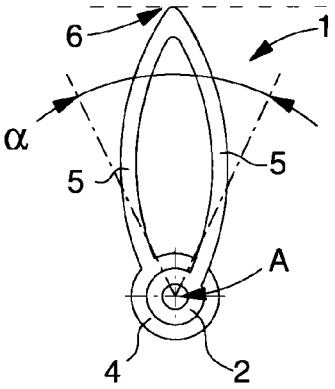
Figure 2C:
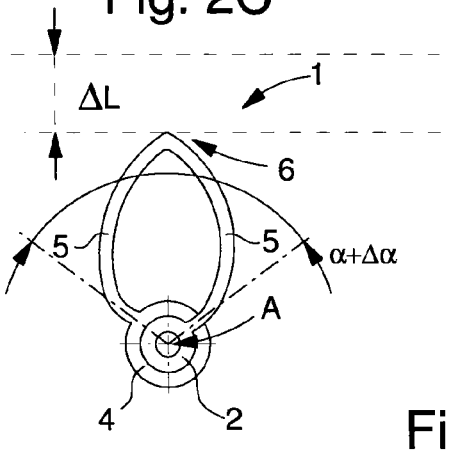
Figure 10:
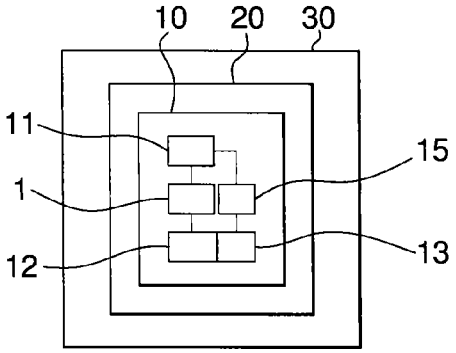
FIG. 10 is a block diagram of a timepiece including a movement which in turn includes a display mechanism with a resilient hand according to the invention.

FIGS. 2A to 2C illustrate the principle of the invention: FIG. 2A shows a resilient hand 1, made of silicon or similar, or of a micro-material created by a "DRIE" or "LIGA" method, gross of fabrication: resilient hand 1 is formed of two flexible segments 5 joined at a common tip 6. At the free ends 52, 54 of these segments 5, there is a first pipe 2 and a second pipe 4. Preferably, segments 5 form together a single flexible strip 3.

By superposing first pipe 2 and second pipe 4 at a certain angle $\alpha$, a resilient hand 1 is formed whose shaft portion? is hollowed. When angle $\alpha$ is varied, the two flexible segments 5 are deformed. As a result, the apparent length of resilient hand 1 varies.

Figure 3:
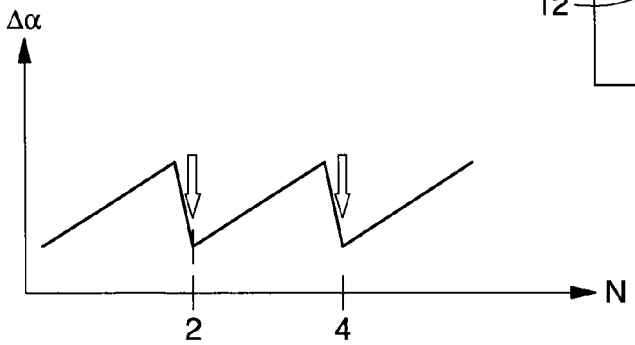
FIG. 3 is a graph illustrating the variant in angular shift, on the ordinate axis, according to the angle of revolution on the abscissa axis.

The spiral trajectory of resilient hand 1 in FIG. 1 means that the variation in angle $\Delta\alpha$ obeys the diagram of FIG. 3: every second revolution, resilient hand 1 accumulates an angle difference $\Delta\alpha$ which must be reset to zero by an instantaneous jump.

A simple example of display mechanism 10 illustrated in FIG. 4 fulfils this function. The continuous arrows of FIG. 4 indicate the direction of pivoting of the elements, while the discontinuous arrows indicate the direction of application of torques or forces. First drive means 11 include a first drive pinion 21 for first pipe 2, said first pinion 21 is driven by a first drive wheel 22. Second drive means 13 include a second drive pinion 23 for second pipe 4, said second pinion 23 is driven by a second drive wheel 24. The transmission ratios in this particular example are such that, when first pipe 2 rotates through 2 revolutions, second pipe 4 only completes 1.8 revolutions. The angle difference of 0.2 revolutions in this example has to be adapted to the hand or vice versa, and is acquired linearly, continuously, throughout the two revolutions. To perform the instantaneous jump, the second drive wheel 24 includes a sector 25 with no teeth, forming a notch, which makes it possible for resilient hand 1 to be tightened again at the end of the second revolution, in the movement illustrated by a double arrow in FIGS. 1 and 3. The torque constantly exerted by resilient hand 1 allows the missing tooth or teeth to pass without resilient hand 1 pausing.

Figure 5A:
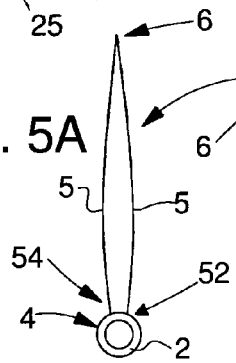
FIGS. 5A to 5C show schematic plan views of a single-piece resilient hand according to the invention, with variable radial extension.
Figure 5B:
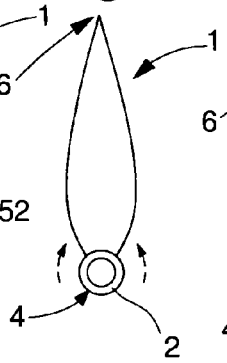
Figure 5C:
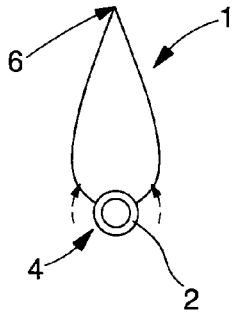

It is important for the resilient hand to be permanently prestressed in the "long or short" state. The resilient hand thus constantly exerts a torque on the gear train, as seen in FIGS. 5A to 5C:

In FIG. 5A at rest: first pipe 2 and second pipe 4 are superposed, this configuration never occurs during movement;

In FIG. 5B, long position: a torque tends to move the two pipes closer together;

In FIG. 5C, short position: a torque tends to move the two pipes closer together.

The fact that resilient hand 1 is constantly stressed allows the jump to be performed at the end of the spiral trajectory (double arrow in FIGS. 1 and 3), prevents any play in the gear train and also allows the jump to be performed in dead time. Indeed, the gear train does not stop since the torque in resilient hand 1 takes up the play between the teeth and also the empty space in sector 25. In this particular case of the FIG. 4 example, the angle difference $\Delta\alpha$ is 0.2 revolutions. This differential $\Delta\alpha$ depends on the design of resilient hand 1 or vice versa.

Flexible resilient hand 1 may have other shapes. In each case, single-piece, flexible, resilient hand 1 preferably includes two pipes, and display mechanism 10 makes it possible, by varying the angle of these two pipes, to vary the length, or radial extension of resilient hand 1.

FIGS. 6A and 6B show a variant of hand 1 with a solid part 60 attached to pipes 2 and 4 by flexible strips 520 and 540 on two levels, these flexible strips 520 and 540 being wound around pipes 2 and 4 respectively.

This type of resilient hand 1 of variable length allows great freedom of shape, and as seen in FIGS. 7A to 7D, makes it possible to form the trajectory of tip 6 respectively on a spiral, concentric circles, a square, an oval, or intersecting lobes, or other shapes, these trajectories being non-limiting.

Figure 8:
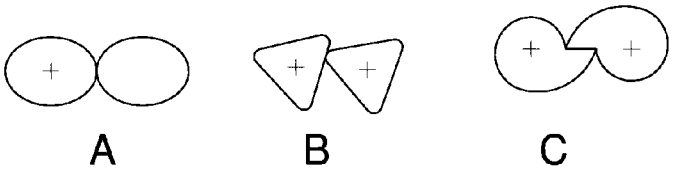
FIG. 8 shows at A, B, C, various transmission with a non-constant ratio for modifying the length of the resilient hand.

As regards the drive means, it is possible to define particular teeth assemblies to obtain certain trajectories mechanically. A non-circular trajectory is defined by the transmission ratio between the two pipes. Non-cylindrical toothed wheels, for example two ovoid cams, have a non-constant transmission ratio which periodically modifies the length of resilient hand 1. FIGS. 8A to C illustrate non-limiting examples of particular drive means applicable to this complication. The variable transmission ratios obtained in FIG. 8 are innovative and allow great design freedom for the trajectories.

The invention also concerns a timepiece movement 20 including at least one display mechanism 10 of this type.

The invention also concerns a timepiece 30 including at least one timepiece movement 20 of this type and/or including at least one striking mechanism or a music box mechanism including a display mechanism 10 of this type. In an advantageous application, the timepiece 30 is a watch.

The invention also concerns a scientific apparatus 30 including at least one timepiece movement 20 of this type and/or including at least one display mechanism 10 of this type.

Flexible, resilient hands 1 according to the invention are easy to make in silicon or similar type materials, using "DRIE" or "LIGA" or similar methods, and they require no assembly. These technologies are advantageous since they allow for multi-level production, for example a hand according to FIG. 6B may include a first level with first pipe 2 and the adjacent first segment 520, solid part 60 is formed of the extension of this first level by a second level, and second segment 540 and second pipe 4 are created on this second level.

Display mechanisms 10 including indicators of this type permit wider exploitation of the possibilities of the movements 20 or mechanisms of scientific apparatuses or timepieces 30, with more precise display over wider value ranges.

The invention lends itself to the manufacture of shape memory indicators, to attract the user's attention to a particular circumstance. Reference may thus be made to an apparently hinged hand, which changes into a substantially aligned position of its constituent segments in one part of its travel, and which is completely deformed to take a particular shape in a broken line during a change of range, or during operation of a mechanism or a circuit of the timepiece or of the scientific apparatus, for example an alarm clock or alarm when a danger threshold or similar is detected. Another application is the animation of the silhouette of a person or object in an aperture, in similar circumstances.

What is claimed is:

1. A resilient timepiece hand, including a first drive pipe integral with a flexible strip, wherein said resilient hand is in a single-piece and of variable geometry and said flexible strip includes a plurality of flexible segments connected end-to-end at at least one tip, wherein a first segment, which is flexible between said first pipe and a first tip and which is deformable between a first compressed position wherein said first tip is at a first close distance from said first pipe, and a first relaxed position wherein said first tip is at a first remote distance from said first pipe which is greater than said first close distance, said resilient hand includes a second drive pipe also integral with said flexible strip, and said first pipe and said second pipe are spaced apart from each other in a free state of said resilient hand, and are mounted coaxially to each other along a common axis in a stressed operating state of said resilient hand which is a stressed state wherein said first pipe and said second pipe can each occupy different angular positions, and said flexible strip includes at least a second flexible segment between said second pipe and an intermediate tip which is one of said at least one tip, and said second flexible segment is deformable between a second compressed position wherein said intermediate tip is at a second close distance from said second pipe, and a second relaxed position wherein said intermediate tip is at a second remote distance from said second pipe which is greater than said second close distance.

2. The resilient hand according to claim 1, wherein said resilient hand includes only said first segment, carrying said first pipe at a first end, and said second segment, carrying said second pipe at a second end connected to each other by said first tip, and, in said free state of said resilient hand, said first end and said second end are remote from each other and form a non-zero angle with said first tip.

3. The resilient hand according to claim 1, wherein, in said stressed operating state of said resilient hand where said first pipe and said second pipe are movable with respect to each other and coaxial along said common axis, a distance between said at least one tip and said common axis is a function of angular deviation between a first angular position of said first pipe and a second angular position of said second pipe.

4. The resilient hand according to claim 1, wherein said at least one tip includes a stylus arranged to follow a cam path.

5. A timepiece display mechanism including at least one resilient hand according to claim 1, wherein the mechanism includes first means of driving said first pipe of said at least one resilient hand about a pivot axis, and second means of stressing said at least one resilient hand to vary the position of said at least one tip of said at least one resilient hand with respect to said pivot axis.

6. The mechanism according to claim 5, wherein said second stressing means include at least one guide path or cam for a said tip or for an extension of a said tip.

7. The mechanism according to claim 5, wherein said second stressing means include second means of driving said second pipe.

8. The mechanism according to claim 7, wherein said second means of driving said second pipe are coaxial to said first means of driving said first pipe.

9. The mechanism according to claim 7, wherein, in said stressed operating state, said resilient hand is arranged to permanently exert on said first drive means and on said second drive means a torque tending to take up operating plays between said first and second drive means.

10. The mechanism according to claim 8, wherein the pivoting speeds of said first drive means and of said second drive means are different, and the deviation over a given travel of said first pipe is taken up by a jump between said first drive means and said second drive means.

11. The mechanism according to claim 10, wherein the pivoting speeds of said first drive means and of said second drive means are different, and the deviation over an integer number of revolutions of said first pipe is taken up by a jump between said first drive means and said second drive means.

12. The mechanism according to claim 7, wherein the mechanism includes control means for controlling pivoting speeds of said first drive means and of said second drive means and an angular position of at least said first pipe, said control means being arranged to impose a particular trajectory on said at least one tip of said at least one resilient hand.

13. A timepiece movement including at least one display mechanism according to claim 5.

14. A timepiece including at least one of:

at least one timepiece movement including at least one display mechanism according to claim 5, and at least one striking mechanism or a music box mechanism including the display mechanism according to claim 5.

15. The timepiece according to the claim 14, wherein the timepiece is a watch.

16. A scientific apparatus including at least one of:

at least one timepiece movement including at least one display mechanism according to claim 5, and the at least one display mechanism according to claim 5.

* * * * *